US006058154A

United States Patent [19]

Chanzy et al.

[11] Patent Number: 6,058,154

[45] Date of Patent: May 2, 2000

[54] LEAKTIGHT CLOSURE APPARATUS FOR MULTI-USE CONTAINMENT UNIT FOR IRRADIATED NUCLEAR FUEL ASSEMBLIES OR HIGH-ACTIVITY WASTE

[75] Inventors: Yves Chanzy, Paris; Vincent Roland, Sevres, both of France

[73] Assignee: Societe pour les Transports de l'Industrie Nucleaire-Transnuclarie, Paris, France

[21] Appl. No.: 09/059,198

[22] Filed: Apr. 14, 1998

[30] Foreign Application Priority Data

May 6, 1997 [FR] France ..... 97-05861

[51] Int. Cl.[7] ..... G21C 19/00; G21C 19/32; G21F 5/008

[52] U.S. Cl. ..... 376/272; 250/505.1; 250/506.1

[58] Field of Search ..... 376/260, 272; 250/505.1, 506.1, 507.1

[56] References Cited

U.S. PATENT DOCUMENTS

| | | | |
|---|---|---|---|
| 4,274,007 | 6/1981 | Baatz et al. | 250/506.1 |
| 4,308,460 | 12/1981 | Groh et al. | 250/506 |
| 4,445,042 | 4/1984 | Baatz et al. | 250/506.1 |
| 4,465,201 | 8/1984 | Chalfant, Jr. | 220/3 |
| 4,528,454 | 7/1985 | Baatz et al. | 250/506.1 |
| 4,599,518 | 7/1986 | Schmidt et al. | 250/507.1 |
| 4,760,268 | 7/1988 | Noe | 250/506.1 |
| 4,818,878 | 4/1989 | Popp et al. | 250/507.1 |
| 4,893,022 | 1/1990 | Hall et al. | 250/506.1 |
| 4,996,019 | 2/1991 | Catalayoud et al. | 376/272 |
| 5,061,858 | 10/1991 | Malloy | 250/507.1 |
| 5,391,887 | 2/1995 | Murray, Jr. | 250/506.1 |
| 5,438,597 | 8/1995 | Lehnert et al. | 376/272 |
| 5,471,065 | 11/1995 | Harrell et al. | 250/506.1 |
| 5,753,925 | 5/1998 | Yamanaka et al. | 250/507.1 |

*Primary Examiner*—Charles T. Jordan
*Assistant Examiner*—Jack Keith
*Attorney, Agent, or Firm*—Dennison, Scheiner, Schultz & Wakeman

[57] ABSTRACT

A sealable metal multipurpose canister for confining irradiated nuclear fuel assemblies and a sealing means therefor. The canister includes a tubular or cylindrical body having a vertical major axis and vertical wall, a lower end closed by a welded base and an open and sealable upper end having a vertical inner wall section including a transverse shoulder extending over at least a portion of the vertical inner wall. The sealing means includes a first solid metal sealing disk supported by the transverse shoulder and having a peripheral portion cooperating sealingly with the vertical inner wall, a second solid metal sealing disk resting on and above the first sealing disk and having a peripheral portion cooperating sealingly with the vertical inner wall and a gripping means located inside the upper end above the second sealing disk, and acting on the first and second sealing disks to create a leaktight seal.

8 Claims, 2 Drawing Sheets

LEAKTIGHT CLOSURE APPARATUS FOR MULTI-USE CONTAINMENT UNIT FOR IRRADIATED NUCLEAR FUEL ASSEMBLIES OR HIGH-ACTIVITY WASTE

FIELD OF THE INVENTION

The present invention relates to a leaktight closure apparatus using seals for a multi-use containment unit, for example for irradiated nuclear fuel assemblies or high-activity waste.

DESCRIPTION OF RELATED ART

A technique for shipping and storing irradiated fuel assemblies is being developed.

Briefly, the technique consists of:

- introducing a thin-walled metal box, one of whose ends opens fully, into a thick-walled metal external packing that can be hermetically closed. Said unit acts to confine the radioactive material while providing satisfactory mechanical resistance. The thick external packing provides adequate radioactive shielding and most of the mechanical resistance so that the entire package consisting of the external packing, the containment unit and the radioactive contents can be transported, i.e. meets the regulatory specifications governing serious accidents such as dropping,
- introducing the container assembly, i.e. the external packing and the unit, into the pool used for storing irradiated nuclear fuels for shipping,
- loading said irradiated fuel assemblies into the unit,
- positioning the cover of the unit to ensure that the radioactive material is confined and then draining the unit,
- drying the inside of the unit, possible outside the pool, and hermetically closing the resulting package.

Said package may then be shipped to its destination in complete safety. The containment unit is then removed from its external packing and stored in the required location.

The multi-use containment unit is also known in English as a "Multi-Purpose Canister" (MPC) and the external packing is known as an "Over-Pack" (OP).

The open end of the unit is usually hermetically sealed, either by means of a welded cap or, reversibly, using seals gripped between a cap and a collar fastened to the open end of said unit.

FIG. 1 shows this type of reversible closure by means of seals.

FIG. 1 shows the thin wall (1) of the multi-purpose canister (MPC). Reference (2) is the internal cavity of the unit into which the irradiated nuclear fuel assemblies are introduced, and (3) is the collar fastened to the upper open end of the unit. (4) is the cap comprising two seals (5) in their housings that ensure a leaktight seal once the cap has been closed by means of bolts (6).

In this type of closing apparatus it will be seen that after introducing the unit into the overpack, the collar (3) rests on the upper end of the overpack (7).

Therefore operations to insert or remove the reversible seal unit into or from the overpack can only be carried out via said open end of the overpack. This means that the operations must be carried out either in a shielded cell or similar apparatus, or in a pool to provide the radiological protection that the multi-purpose canister is incapable of providing.

In order to facilitate insertion and extraction of the multi-purpose canister into and out of the over-pack in the vertical position and avoid the use of an intermediate shielded apparatus between the over-pack and the required storage site, it is advantageous to use an over-pack that fully opens at its lower as well as its upper end. Thus, once the bottom of the over-pack has been removed and the package has been positioned immediately above the storage site, the unit containing the irradiated fuel assemblies may be removed via the lower end of said over-pack by sliding it out.

It will be clear that the presence of a collar on the unit prevents this type of handling in which the unit is inserted into the over-pack via the top end and removed via the bottom end.

In order to carry out these handling operations it is therefore essential that outer surface of the unit is smooth and fitted with no protruding collar. The applicant has therefore aimed at developing this type of unit that has both a reliable reversible leaktight closure, but that is also easy to produce and has no features that project from the outer cylindrical wall.

SUMMARY OF THE INVENTION

The invention is a removable sealed closing apparatus for a metal multi-purpose canister (MPC) for irradiated nuclear fuel assemblies, composed mainly of a tubular or cylindrical body, normally circular in cross-section, having a single major axis and a lower end that is closed by a welded base and an upper end that is completely open. Said unit is designed to be entirely enclosed in a thick-walled over-pack, said leaktight closure apparatus comprising:

- at least two removable solid metal disks that are entirely located inside said tubular body, bearing directly or via a support disk or collar, on a shoulder constructed in the upper section of all or part of the periphery of the inner wall of the tubular body, each of said solid metal disks comprising sealing means located at their periphery and co-operating with the inner wall of the tubular body,
- gripping apparatus also located inside the tubular body above said solid metal disks and acting on them to create a leaktight seal.

The solid disks are thus stacked on top of one another and, as will be seen below, the leaktight seal is particularly created between the sealing means located at the periphery of the solid metal disks and the vertical wall of the tubular body.

The support disk may also be a collar. Furthermore, the lowest solid disk comprising sealing means may bear directly on said shoulder without interposition of a support disk or collar.

As will be seen in detail below, the sealing means normally comprise O-rings that are compressed by means of the gripping apparatus, which may be of a known type.

The tubular body of the multi-purpose canister generally has thin walls that may be between 1 and 10 cm. More usually, however, they are between 2 and 5 cm thick, but despite this the apparatus of the invention ensures the leaktightness of the unit over time. In contrast, the walls of the over-pack are of the order of 10 to 30 cm thick, but more usually between 15 and 25 cm. The diameter of the multi-purpose canister is normally between 0.5 and 2.5 meters, most commonly between 1.5 and 2 meters, and its length, depending on the fuel assemblies it is designed to contain, varies between 3 and 5 meters.

The solid disks and the bearing disk or collar are normally at least 15 mm thick. This thickness is related to the thickness of the seal and designed to avoid the risk of distortion by the gripping action ensuring the leaktight seal.

The thickness of the disks is normally less than 50 mm to avoid adding any disadvantageous extra weight to the canister and to leave more space available for the contents.

The closure apparatus of the invention may also comprise apparatuses for testing leaktightness. For this purpose the invention uses at least two solid metal disks fitted with sealing means; leaktightness can therefore be tested and therefore guaranteed.

This type of closure apparatus composed of at least two components (i.e. a metal disk and a gripping apparatus) may be penetrated by an aperture comprising its own sealing system comprising, for example, two seals whose leaktightness can be tested.

DESCRIPTION OF THE PREFERRED EMBODIMENTS

Figure 1:
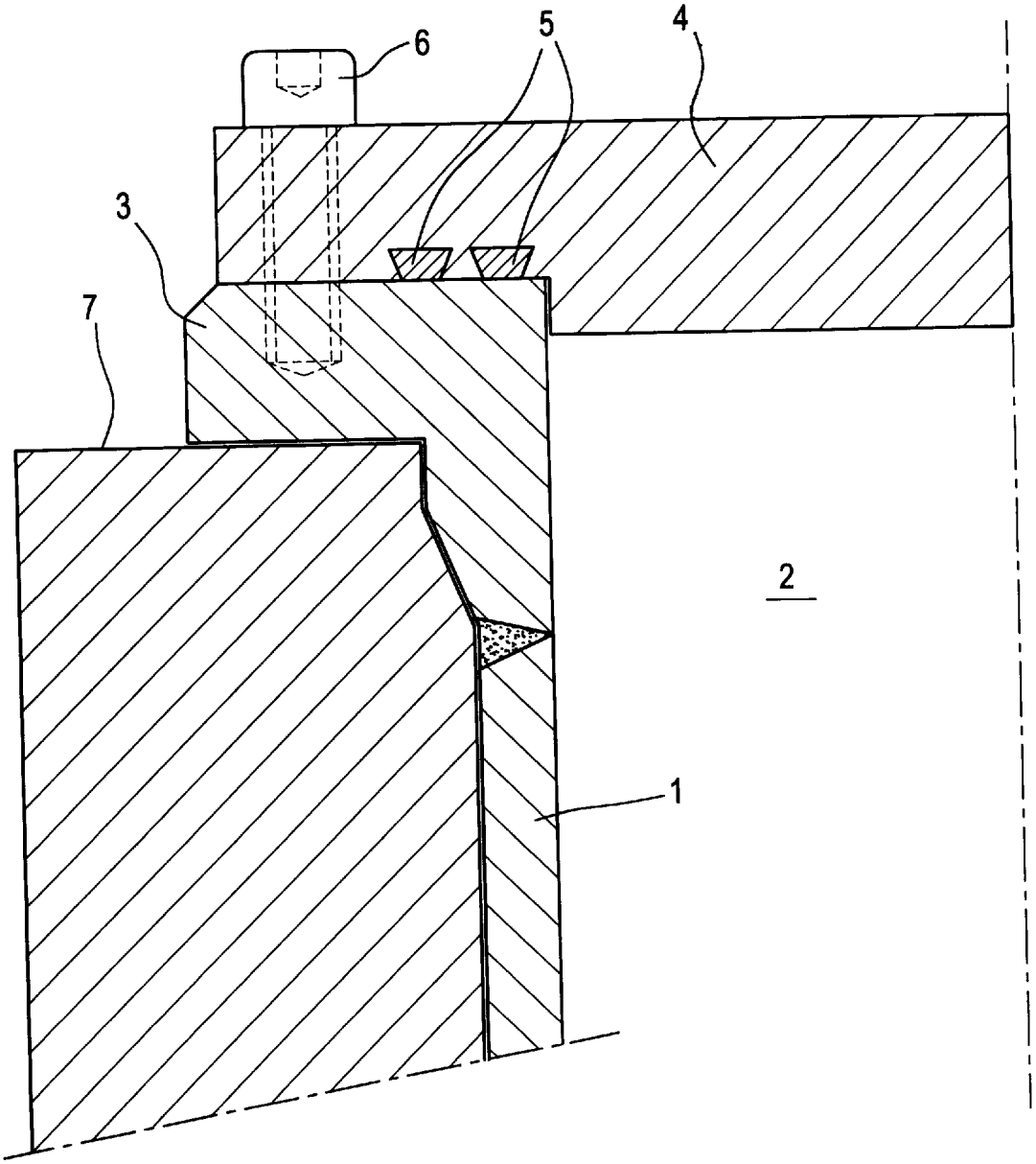
FIG. 1 PRIOR ART
FIG. 1 is a cross-sectional view of a portion of a multipurpose canister according to the prior art.
Figure 2:
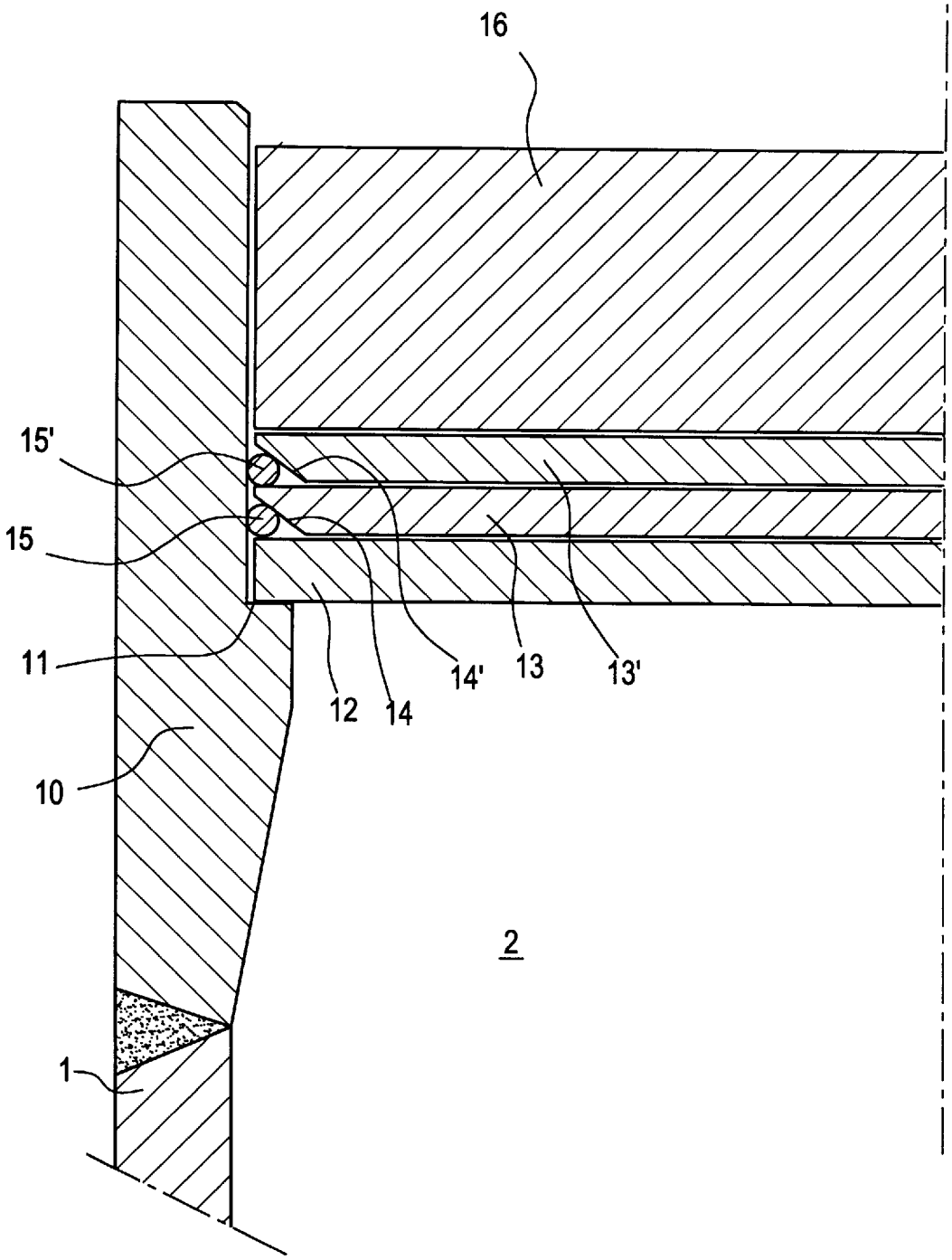
FIG. 2 is a cross-sectional view of a multipurpose canister according to the invention.

As shown in FIG. 2, the invention appears particularly simple to construct and implement and the container assembly has a perfectly smooth, cylindrical outer surface and its entire length is free from rough projections.

In FIG. 2, reference (1) is the thin wall of the tubular body of the multi-purpose canister, (2) is the inner cavity designed to house the irradiated fuel assemblies placed in an appropriate holder. The upper end (10) of the tubular body may have the same thickness as the body but here it has been welded on and has a slight additional thickness inside said tubular body. Like the tubular body it is circular in cross-section except for certain places, for example when the shoulder (11) does not run around the entire periphery of the inner wall of the tubular body, as will be seen below. The external walls of the tubular body (vertical in this example) and its upper end (10), which may be added on, are aligned so that there are no projections capable of causing an obstruction. The optional internal overthickness gives the upper end (10) of the unit increased rigidity so that the guaranteed leaktightness of the apparatus according to the invention is improved without reducing the capacity of said unit.

The upper end (10) has a shoulder (11) cut into the inner wall; this shoulder may be cut into the entire periphery of said inner wall or only part thereof. The shoulder ensures that the support for the bearing disk or collar (12) is stable. The bearing disk or collar is circular and has an upper surface, a lower surface and a cylindrical lateral wall.

On the upper surface of the circular bearing disk or collar (12) is placed a first solid disk (13). The periphery of said solid disk (13) essentially of circular shape comprises sealing means comprising a bevel (14) cut into the periphery of its lower edge and an O-ring (15) that is usually made of metal placed in the housing created by said bevel (14). The metal seal may be of the Helicoflex™ or any other type of metal seal having similar properties.

In another embodiment the first solid disk (13), which is in the lower position, bears directly on the shoulder (11).

Leaktightness is ensured by the O-ring (15) between the circular cross-section vertical cylindrical inner wall of the upper end (10), or the end of tubular body (1) where no specific end-piece has been added, and either the surface of the bevel or the upper horizontal surface of the support disk.

This embodiment using a support disk is particularly advantageous since it compresses the O-ring (15) and ensures leaktightness when the shoulder (11) is not cut into the entire periphery of the inner wall. It achieves this in particular because said leaktight seal is partly obtained due to pressure of the seal on the vertical section of the inner wall.

In order to both guarantee improved leaktightness and improve testing of the leaktightness obtained, a second solid disk (13') that is identical to first solid disk (13), complete with bevel (14') and metal seal (15') is placed on the upper surface of the disk (13). Seal (15') is also compressed due to the action of the upper surface of the first solid disk (13) in lower position on which it is placed.

The gripping apparatus (16) is entirely located inside the upper end (10) of tubular body (1). This is normally of known type and comprises gripping means that operate in conjunction with the inner wall, thereby making the closure of the unit leaktight by compressing the seals (15, 15') and pressing vertically on the upper disk.

It will be seen that, as the assembly is tightened, the seals (15, 15') are compressed to create a leaktight seal between the bevels of the first and second solid disks (13) and (13') and the inner wall of the upper end (10) of the end of the tubular body (1).

The number of solid disks may simply be increased to give further improvements in the degree of leaktightness required.

It will be seen that the reversible closure apparatus of the invention is easy to produce. It also allows a multi-purpose canister to pass all the way through an over-pack from one end to the other and also gives a high degree of leaktightness and mechanical resistance that meets the requirements of the safety regulations.

What is claimed is:

1. A canister unit including a sealable metal canister for confining irradiated nuclear fuel assemblies, and a reversible leaktight closure means therefor, the sealable metal canister comprising a tubular body having a cylindrical wall, a base closing a first end of said cylindrical wall, an open end adapted to be closed by said reversible leaktight closure means, and a transverse shoulder formed peripherally around an inner surface of the tubular body in its entirety at said open end;

said reversible leaktight closure means comprising:

a first solid metal sealing disk adapted to rest directly on said transverse shoulder, a first bevel being formed peripherally around of a face of said first disk facing said shoulder;

a first O-ring seal disposed in a space defined by said shoulder, said first bevel and said inner surface;

a second solid metal sealing disk adapted to rest directly on said first sealing disk, a second bevel being formed peripherally around of a face of said second disk facing the first disk;

a second O-ring seal disposed in a space defined by said first disk, said second bevel and said inner surface; and gripping means disposed entirely inside the open end of the cylindrical wall and pressing on the second sealing disk to compress the second 0-ring seal and create a leaktight seal in the space defined by the second bevel, the first disk and said inner surface, and to compress the first seal and create a leaktight seal in the space defined by the first bevel, the shoulder and said inner surface.

2. A canister unit including a sealable metal canister for confining irradiated nuclear fuel assemblies, and reversible leaktight closure means therefor, the sealable metal canister comprising a tubular body having a cylindrical wall, a base closing a first end of said cylindrical wall, an open end adapted to be closed by said reversible leaktight closure means, and a transverse shoulder formed peripherally around at least a portion of an inner surface of the tubular body at said open end, said reversible leaktight closure means comprising:

a solid metal support disk adapted to rest directly on said transverse shoulder;

a first solid metal sealing disk adapted to rest directly on said support disk, a first bevel being formed peripherally around a face of said first disk facing said support disk;

a first O-ring seal disposed in a space defined by said support disk, said first bevel and said inner surface;

a second solid metal sealing disk resting directly on said first sealing disk, a second bevel being formed periphery around a face of said second disk facing the first disk;

a second O-seal ring disposed in a space defined by said first disk, said second bevel and said inner surface; and gripping means disposed entirely inside the open end of the cylindrical wall and pressing on the second sealing disk to compress the second seal and create a leaktight seal in the space defined by the second bevel, the first disk and said inner surface, and to compress the first seal and create a leaktight seal in the space defined by the first bevel, the support disk and said inner surface.

3. The canister unit of claim 1, wherein the first and second O-ring seals are metal seals.

4. The canister unit of claim 1, wherein said tubular body is between 1 and 10 mm thick and has a diameter between 0.5 and 2.5 m, each of the first and second disks having a thickness of at least 15 mm.

5. The canister unit of claim 2, wherein the first and second O-ring seals are metal seals.

6. The canister unit of claim 2, wherein said tubular body is between 1 and 10 mm thick and has a diameter between 0.5 and 2.5 m, each of the first and second disks having a thickness of at least 15 mm.

7. The canister unit of claim 1, wherein the cylindrical wall comprises a smooth outer surface.

8. The canister unit of claim 2, wherein the cylindrical wall comprises a smooth outer surface.

* * * * *